US008388186B2

(12) United States Patent
Fu

(10) Patent No.: US 8,388,186 B2
(45) Date of Patent: Mar. 5, 2013

(54) LAMP SHADE HAVING INTERLOCKING SECTIONS

(75) Inventor: Jeff Fu, Taipei (TW)

(73) Assignee: Arcadia, Taipei (TW)

( * ) Notice: Subject to any disclaimer, the term of this patent is extended or adjusted under 35 U.S.C. 154(b) by 33 days.

(21) Appl. No.: 13/116,191

(22) Filed: May 26, 2011

(65) Prior Publication Data

US 2012/0300473 A1 Nov. 29, 2012

(51) Int. Cl.
*F21V 29/00* (2006.01)

(52) U.S. Cl. ..... 362/267; 362/294

(58) Field of Classification Search ..... 362/360, 362/294, 368, 353, 267, 351
See application file for complete search history.

(56) References Cited

U.S. PATENT DOCUMENTS 3,112,894 A * 12/1963 Pearlman ..... 362/294
5,588,741 A * 12/1996 Huang ..... 362/267
5,980,068 A * 11/1999 Yu ..... 362/351
6,135,623 A * 10/2000 Lin ..... 362/431
7,367,688 B1 * 5/2008 Bucher et al. ..... 362/267
7,488,090 B1 * 2/2009 Bucher et al. ..... 362/267

* cited by examiner

*Primary Examiner* — Mariceli Santiago
*Assistant Examiner* — Glenn Zimmerman
(74) *Attorney, Agent, or Firm* — Leason Ellis LLP

(57) ABSTRACT

A lamp shade includes first and second interlocking shade sections. Each of the first and second interlocking shade sections is made of a plastic material and has a different color than the other section. The lamp shade also includes a bulb socket supported by the first interlocking shade section and at least partially surrounded by a plurality of ventilation holes. One of the first and second interlocking shade sections has an annular recess and a set of spaced fingers within the annular recess. The other of the first and second interlocking shade sections has a radially inwardly directed annular flange. The annular flange including a set of slots sufficient in number and sized so as to receive the fingers, whereby the fingers are received in and rotatable relative to the slots to interlock the first and second interlocking shade sections.

11 Claims, 2 Drawing Sheets

LAMP SHADE HAVING INTERLOCKING SECTIONS

TECHNICAL FIELD

The present invention relates to an improved desk lamp and in particular, to a desk lamp shade that has interlocking sections to provide a visually pleasing look by having more than one color.

BACKGROUND

There are wide range of different lighting products including desk lamps and floor lamps, as well as track lighting fixtures and the like. Desk lamps have been used for desks, offices and studies so as to provide illumination for reading or other purposes and so that one's eyesight is not weakened by the insufficiency of illumination. Hence, these types of lighting products are useful and needed.

A conventional desk lamp is generally composed of three parts, namely, a base, an arm, and a shade. Making the shades from plastic reduces the cost of the product. However, there are tradeoffs with using a plastic material. In particular, a plastic material is provided in one color and it is difficult to change the color of the plastic material. Thus, the lamp shade is provided in one color.

It would therefore be advantageous to provide a lamp shade that can be made of plastic and offers more than one color.

SUMMARY

In accordance with the present invention, a lamp shade includes first and second interlocking shade sections. Each of the first and second interlocking shade sections is made of a plastic material and has a different color than the other section. The lamp shade also includes a bulb socket supported by the first interlocking shade section and at least partially surrounded by a plurality of ventilation holes. One of the first and second interlocking shade sections has an annular recess and a set of spaced fingers within the annular recess. The other of the first and second interlocking shade sections has a radially inwardly directed annular flange. The annular flange including a set of slots sufficient in number and sized so as to receive the fingers, whereby the fingers are received in and rotatable relative to the slots to interlock the first and second interlocking shade sections.

These and other aspects, features and advantages shall be apparent from the accompanying Drawings and description of certain embodiments of the invention.

DETAILED DESCRIPTION OF CERTAIN EMBODIMENTS OF THE INVENTION

Figures 1, 2:
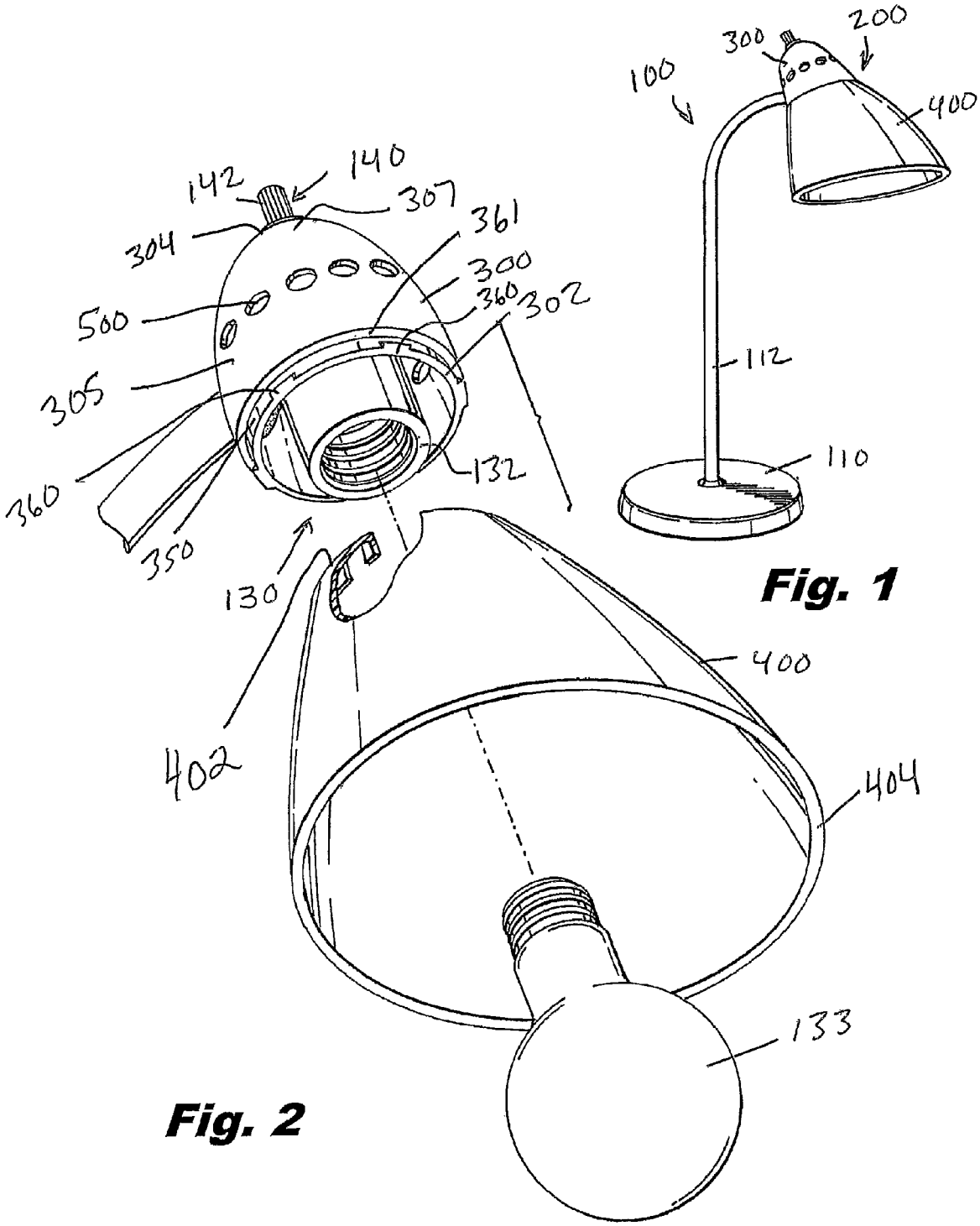
FIG. 1 is a front and side perspective view of the components of a desk lamp in accordance with one embodiment of the present invention with the lamp shade fully installed.
FIG. 2 is a an underside exploded perspective view of a bulb, shade, socket and lamp shade housing.

FIG. 1 shows a lamp 100 that is formed of a base 110, an arm or neck 112 and a lamp shade assembly 200. The arm 112 is attached at one end to the base 110 and at the other end to the lamp shade assembly 200. The arm 112 is typically adjustable to permit the lamp shade assembly 200 to move relative to the base 110.

As shown in FIG. 2, the lamp 100 also includes a light unit 130 that is disposed at least partially within the lamp shade assembly 200 and a control unit 140. The light unit 130 includes components for generating light and in particular can include a lamp socket 132 that includes a conductive element and is electrically connected to the control unit 140 for controlled operation of the light unit 130. The light unit can include any number of different light sources, including different types of bulbs 133, such as incandescent bulbs, halogen bulbs, LED, etc. The illustrated socket 132 receives a conventional bulb 133 that has a hollow center part that receives a bulb.

The control unit 140 can be in the form of a switch 142 that is electrically connected to the socket 132. In addition, a power cable 150 is provided for delivering power to the lamp socket 132 for powering of the bulb.

In accordance with the present invention, the lamp shade assembly 200 includes a first shade section 300 and a second shade section 400 that are coupled to one another as described below. The first shade section 300 surrounds the socket 132, while the second shade section 400 is the lamp shade housing or section that surrounds the light bulb (light source) and through which the light is diffused.

In accordance with the present invention, the first shade section 300 and the second shade section 400 are formed of plastic and are visually different from one another. For example, the first shade section 300 can be formed of a first color and the second shade section 400 can be formed of a second color different from the first color. One will appreciate that the number of color combinations is vast and this allows the lamp shade assembly 200 to be customized and also allows the emitted light characteristics to be changed. For example, the first shade section can have a red color and the second shade section 400 can have a white color or vice versa. The inner shade component can have a lighter color than the outer shade component or alternatively, the opposite can be true in that the inner shade component can have a darker color. Since the second section 400 is the main section that surrounds the light source (light bulb), the color of the plastic in this section is illuminated and "glows" this color.

It will also be appreciated that the two sections 300, 400 can be visually different from one another in some other way besides being a different color. For example, one section 300, 400 can include a pattern, while the other section 400, 300 can be solid. It will also be appreciated that other patterns are possible. However, typically, one section 300, 400 will be one solid color, while the other section 300, 400 will be another solid color.

Each of the first and second shade sections 300, 400 is a hollow structure and in particular, the first shade section 300 can be a cup-shaped member, while the second shade section 400 can be frustoconical in shape. More specifically, the first shade section 300 includes a first open end 302 and an opposing second substantially closed end 304. Conversely, the second shade section 400 includes a first open end 402 and an opposing second open end 404. The second shade section 400 can have any number of different shapes since it also serves as a decorative piece, while also serving to direct light and prevent a direct line of sight to the light bulb during normal use.

In one embodiment, the first shade section 300 represents the housing the contains the electrical components, such as the socket 132 and the switch 142, while the second shade 400 represents the shade section that surrounds the light source (light bulb) so as to prevent the user from easily touching the light bulb and also providing a decorative shade cover that can allow passage of light and/or direct light to the desk surface. The second shade section 400 therefore likely has dimensions that are greater than the dimensions of the first shade section 300. However, the first end 402 of the second shade section 400 is complementary to the first end 302 of the first shade section 300 to allow mating therebetween and therefore, these two ends have complementary shapes and sizes.

The first and second shade sections 300, 400 can be formed to have any number of different shapes including regular shapes and even irregular shapes. In the illustrated embodiment, the first shade section is cup shaped and thus defined by a continuous side wall 305 and an end portion 307 that at least substantially closes off one end of the continuous side wall 305. The first shade section 300 is a hollow structure that includes a hollow center that receives and holds the socket 132.

One or more of the first and second shade sections 300, 400 can include ventilation holes 500 to permit proper venting of the heat generating components of the lamp, i.e., the light bulb 133 that is contained in the socket 132. Preferably, at least the first shade section 300 has ventilation holes 500. When the second shade section 400 includes ventilation holes 500, the holes 500 can formed near the interface between the two sections 300, 400 or can be formed in another area of the second shade section 400.

The first shade section 300 also includes an end opening at the closed end 304 to permit electrical components (power cable) to be routed from the socket 132 that is contained and fixedly attached within the interior of the lamp shade assembly 200. For example, the power cable can pass through the opening to the socket 132. A coupling member can be used to attach the arm 110 to the lamp shade assembly 200 (e.g., the first shade section 300) and permit the power cable to pass therethrough.

Figure 3:
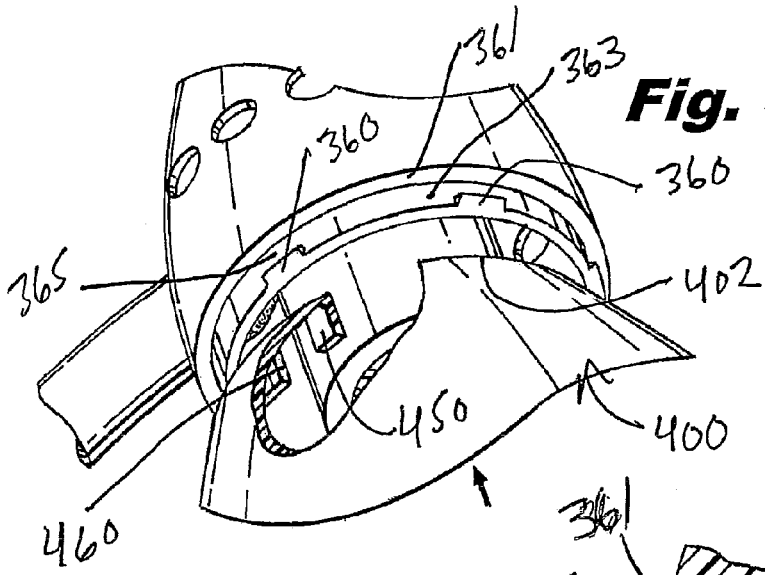
FIG. 3 is a partial exploded perspective view of a first step in assembling the lamp shield assembly by means of a finger associated with one lamp shade part and a complementary notch associated with another lamp shade part.

As shown in FIGS. 2-3, the first shade section 300 has an annular shaped recessed portion 350 that is formed at the open first end 302. The recessed portion 350 represents an annular shaped recessed track or the like that terminates at the end 302. A shoulder (e.g., right angle shoulder) 361 is between the recessed portion 350 and the other portion of the first shade section 300. The recessed portion 350 thus has an outer diameter that is less than the outer diameter of the other portion of the first shade section 300.

The first shade section 300 also includes a plurality of protrusions 360 that are formed within the recessed portion 350 in a spaced manner. The protrusions 360 can be in the form of fingers or the like so long as the structures permit the first and second shade sections 300, 400 to mate with one another in an interlocking manner.

As shown in FIG. 3, there is a space 365 behind each protrusion 360 in that the protrusion 360 does not extend all the way to the shoulder 361. Thus, an uninterrupted, annular shaped track 363 is formed between the protrusions 360 and the shoulder 361.

The second shade section 400 has a complementary construction in that it includes an inwardly directed annular flange 450 formed at the open first end 402. The annular flange 450 thus extends inwardly into the inner space of the second shade section 400. The annular flange 450 can be formed at a right angle relative to the remaining body of the second shade section 400.

The second shade section 400 includes a plurality of slots 460 that are formed within the flange 450 in a spaced manner. The slots 460 are thus complementary to the protrusions 360. For example, the slots 460 can be a rectangular shaped notch and the protrusions 360 can similarly be rectangular shaped protrusions. The annular flange 450 mates with the recessed portion 350 to permit the protrusions 360 to be received within the slots 460 and then coupled to one another as described below.

It will be appreciated that the number of protrusions 360 and notches 460 can vary depending upon the application and design of the lamp and other considerations. In the illustrated embodiment, the first shade section 300 includes four protrusions 360 spaced apart from one another (e.g., spaced 90 degrees apart).

Figure 4:
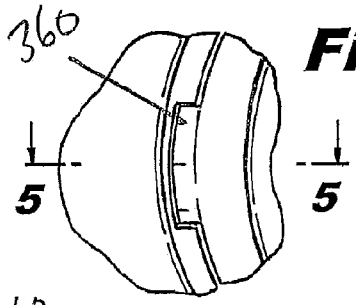
FIG. 4 is an enlarged elevation of the slot receiving the finger.
Figure 5:
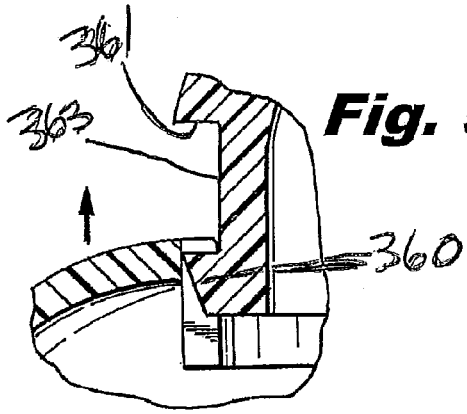
FIG. 5 is a sectional elevation taken at 5-5 of FIG. 4.
Figure 6:
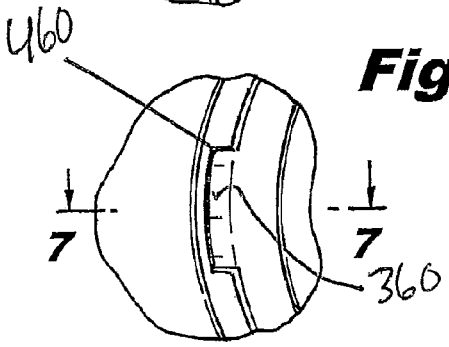
FIG. 6 is like FIG. 4, but with the lamp shade part seated against the housing.
Figure 7:
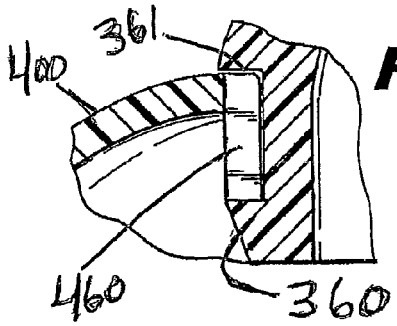
FIG. 7 is a sectional elevation taken at 7-7 of FIG. 6.
Figure 8:
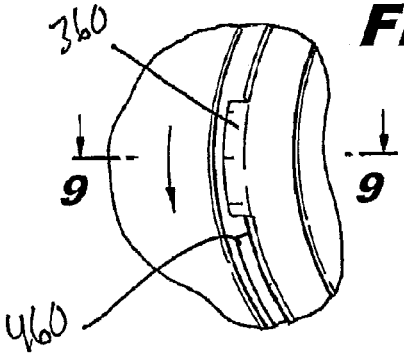
FIG. 8 is like FIG. 6, but with the lamp shade part rotated so the slot is out of alignment with the finger.
Figure 9:
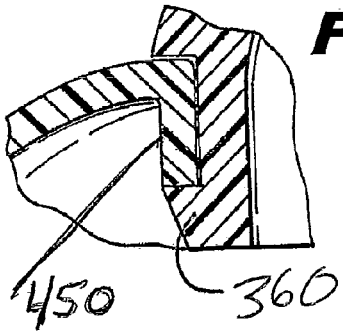
FIG. 9 is a sectional elevation taken at 9-9 of FIG. 8.

The assembly of the first and second shade sections 300, 400 is now described with reference to FIGS. 3-9. To assemble the first and shade sections 300, 400, the first end 402 of the second shade section 400 is placed adjacent the first end 302 of the first shade section 300 (FIG. 3) and the flange 450 is received within the annular recessed portion 350 (FIGS. 4 and 5). The notches (slots) 460 are positioned (by rotating the second shade section 400 relative to the first shade section 300) so that they are aligned with the protrusions 360 and permit reception of the protrusions 360 within the notches 460 (FIGS. 4 and 5). Once the protrusions 360 are received within the notches 460, the flange 450 is moved towards the shoulder 361 and the flange 450 is disposed within the uninterrupted, annular shaped track 363 (FIGS. 6 and 7). The second shade section 400 is then rotated to cause the flange 450 to rotate within the track 363 so as to cause the notches 460 and the protrusions 360 to be out of registration (FIGS. 8 and 9). The second shade section 400 thus cannot be removed from the first shade section 300 by pulling the second shade section 400 outward from the first shade section 300.

The width of the track 363 and the thickness of the flange 450 are about equal so that a frictional (snug) fit results between the two shade sections 300, 400 and the second shade section 400 is securely coupled to the first shade section 300 and surrounds the light source. The second shield section 400 thus extends outwardly from the first shade section 300. The second shield section 400 typically has a greater surface area than the first shield section 300 since it can act as a diffuser and surround the light source.

It will be appreciated that the opposite construction can be true in that the second shade section 400 can include the recessed portion and the protrusions and track, and the first shade section 300 can include the annular flange with notches. The attachment process is the same. It will also be appreciated that other types of mechanical attachments can be used to attach the two shade sections 300, 400.

It will also be understood that the inner surface of the second shield section 400 can include a reflective material (such as a coating or layer) that helps to direct the light to the desk surface.

In accordance with the present invention, the first and second shade sections 300, 400 are attached to one another and can provide a two toned lamp shade look. The present invention thus provides a means for customizing a lamp shade that permits the user to interchange the portion of the lamp shade that surrounds the light source and is thus the portion that is illuminated most when the light source is activated.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A lamp shade comprising:

first and second interlocking shade sections, each of the first and second interlocking shade sections being made of a plastic material and having a different color than the other section;

a bulb socket supported by the first interlocking shade section and being at least partially surrounded by a plurality of ventilation holes; and wherein the first interlocking shade section has at a first end an annular recess which is open in an outward direction and a set of spaced fingers within the annular recess, the spaced fingers extending radially outward;

wherein the second interlocking shade section has a radially inwardly directed annular flange, the annular flange including a set of slots sufficient in number and sized so as to receive the fingers, whereby the fingers are received in and rotatable relative to the slots to interlock the first and second interlocking shade sections.

2. The lamp shade of claim 1, wherein the annular recess is defined by a shoulder with an annular space being formed between the shoulder and inner ends of the fingers.

3. The lamp shade of claim 2, wherein the inner ends of the fingers are defined by vertical walls.

4. The lamp shade of claim 2, wherein in an interlocked, assembled position, the flange is disposed within the annular space that functions as a track, with the fingers being offset from the slots.

5. The lamp shade of claim 1, wherein the first shade section is cup shaped and includes a substantially closed end.

6. The lamp shade of claim 5, wherein a side wall of the first shade section includes an opening for receiving a power cable to attach to the socket.

7. The lamp shade of claim 1, wherein the second shade section is formed of white colored plastic and the first shade section is formed of a color other than white.

8. The lamp shade of claim 1, wherein the second shade section has a frustoconical shape with two open ends.

9. The lamp shade of claim 8, wherein the second shade section has a greater surface area than the first shade section.

10. The lamp shade of claim 1, wherein the second shade section is sized and shaped so as to cover and extend beyond a light bulb received within the socket.

11. The lamp shade of claim 1, wherein the annular recess is defined by a shoulder with an annular space being formed between the shoulder and inner ends of the fingers and an end of the shield section that contains the flange forms a smooth, flush interface between the first and second shield sections due to the end seating flush against the shoulder.

* * * * *